US005931202A

United States Patent [19]

Haeussler et al.

[11] Patent Number: 5,931,202

[45] Date of Patent: Aug. 3, 1999

[54] APPARATUS FOR HOLDING AND GUIDING OF HEALD FRAME RODS IN A WEAVING LOOM

[75] Inventors: Horst Haeussler; Hubertus Ludwig, both of Lindau; Horst Kerner, Lindenberg, all of Germany

[73] Assignee: Lindauer Dornier Gesellschaft mbH, Lindau, Germany

[21] Appl. No.: 08/939,421

[22] Filed: Sep. 29, 1997

[30] Foreign Application Priority Data

Sep. 30, 1996 [DE] Germany ..... 196 40 370

[51] Int. Cl.[6] ..... D03C 1/14; D03C 9/00

[52] U.S. Cl. ..... 139/57; 74/105

[58] Field of Search ..... 139/57, 58, 99 R; 74/88, 45, 101, 102, 103, 126, 128, 129, 105

[56] References Cited

U.S. PATENT DOCUMENTS

| | | | |
|---|---|---|---|
| 3,888,284 | 6/1975 | Tiernan et al. . | |
| 5,483,995 | 1/1996 | Oertli | 139/57 |
| 5,810,055 | 9/1998 | Haeussler et al. | 139/57 |

FOREIGN PATENT DOCUMENTS

| | | | |
|---|---|---|---|
| 182362 | 6/1955 | Australia | 139/57 |
| 0598163 | 5/1994 | European Pat. Off. . | |
| 0654552 | 5/1995 | European Pat. Off. . | |
| 0699788 | 3/1996 | European Pat. Off. . | |
| 0712950 | 5/1996 | European Pat. Off. . | |

*Primary Examiner*—Andy Falik
*Attorney, Agent, or Firm*—W. F. Fasse; W. G. Fasse

[57] ABSTRACT

A holding and guiding mechanism (5, 5') for connecting shaft drive rods (6, 6') in a loom includes a plurality of parallel guide tracks arranged next to each other and extending substantially vertically and defining a guide curve for a prescribed motion path of the drive rods (6, 6'). The guide curve is preferably formed by a circular guide track for a respective drive rod. The upper end of each drive rod is connected through cooperating first and second couplings to one of the heald frames and the lower end of each drive rod is journalled to a shaft drive (8D) for the shed formation when the respective drive rod is an active rod connected to the heald frame or when the respective rod assumes a passive state in which it is also held in the drive and holding mechanism, but the coupling at the upper rod end is disconnected or decoupled at this time from the heald frame. A guided end (7B) of a guide follower (7) secured to the respective drive rod engages the guide track, thus permitting the proper guiding and holding of the passive rods and the proper holding and guiding of the active rods due to the movable connection between the guided end (7B) of the guide follower (7) and the respective guide track (4, 4').

13 Claims, 4 Drawing Sheets

APPARATUS FOR HOLDING AND GUIDING OF HEALD FRAME RODS IN A WEAVING LOOM

FIELD OF THE INVENTION

The invention relates to a device for holding and guiding shaft rods cooperating with a heald frame of a loom. Currently active shaft rods coupled to the heald frame are held and guided in their movement. Currently passive shaft rods are held in place since the passive shaft rods are decoupled from the heald frame until another pattern will be woven.

BACKGROUND INFORMATION

The shaft rods hereafter referred to simply as rods, that form the loom shed in a weaving loom are divided into two groups. One group of rods includes the active rods that form the shed. The other group of rods includes the passive rods which do not participate in the weaving process at the time. For making a group of rods passive, it is known to tilt this group out of the working range of the heald frames. The group of passive rods is mechanically arrested in the passive position by clamping means provided at a respective bellcrank lever. It is also known to hold the passive group of rods in the passive position with a magnetic bar. Further, reference is made to our copending U.S. Ser. No. 08/780,056, filed Dec. 23, 1996 which will issue as U.S. Pat. No. 5,810,055 on Sep. 22, 1998. The disclosure of the copending application is incorporated by reference into the present disclosure.

Where the rods are mechanically arrested in their passive position wear and tear is encountered between the rod and the respective arresting clamp at the bellcrank lever. Such wear and tear is due to machine vibrations occurring during a weaving process. The wear and tear can lead to the loosening of the arresting clamp. Such loosening of the rods in their passive position can lead to substantial mechanical damages in the area of the shaft rods and in the area of the heald frame or shaft. Further, the arresting by a mechanical clamp always requires a manual operation to place the rods into the passive arrested position and such manual operation is labor intensive due to the multitude of rods. Any time when the number of rods in the passive group and/or in the active group needs to be changed, an operator must conventionally perform the manual arresting or release operations. Such work is tedious and ergonomically undesirable.

In the case where the rods are magnetically arrested in their passive position, it is necessary to tilt the passive rods with the bellcrank lever about the respective journal point away from or out of the active position and into contact with a permanent magnet for holding the rods in their passive position. This is a substantial improvement over the mechanical clamping. However, there is still room for improvement, especially with regard to the problem that mechanical vibrations of the loom during its weaving operation can cause the disconnection of a rod from the holding magnet, whereby again damages may be caused, resulting in down time due to necessary repairs, thereby reducing the weaving efficiency of the particular loom.

European Patent Publication EP 0,598,163 A1 discloses an apparatus for holding the shaft rods in a loom, wherein the passive rods are held in a mechanism out of the motion range of the active rods. However, this known structure is neither intended nor suitable for holding the passive rods with their couplings in such a way that a coupling of the rods with the coupling portion secured to the heald frame can be accomplished without the help of an operator. In fact, the operator needs additional equipment for performing any repositioning.

European Patent Publication EP 0,699,788 A1 (Vinciguerra et al.), published on Mar. 6, 1996 discloses a quick coupling system for the heald frames of a loom. A flexible tie element (10, 11) is provided for each bellcrank (6, 7) of each rod. The tie elements are hinged at their lower ends to the respective bellcrank and the top end of the tie element is provided with a head suitable for entering a groove of a guide provided with a stop to limit the motion of the head of a tie element into the respective groove in which the rod is then locked. The heads of the tie elements must be properly aimed into their respective guide slots.

European Patent Publication EP 0,712,950 A1 (Cremonesi), published on May 22, 1996, discloses a quick coupling for the connecting rods (6) to their heald frame. The quick coupling includes first hooks (8) connected to the heald frames (2) and facing downwardly from the heald frames and second hooks (9) reaching upwardly from the respective connecting rod (6). The couplings are operated by bellcranks and a lever mechanism.

Conventionally, the passive rods are so prepositioned that, when a rod change is required, the coupling elements on the side of the rods may require manual help from the operator for coupling the rods to the heald frames.

OBJECTS OF THE INVENTION

In view of the above it is the aim of the invention to achieve the following objects singly or in combination:

- to avoid the drawbacks of the prior art in such a way that the active and passive drive are held and guided of a heald frame to assume a defined position ready for a heald frame change whereby the coupling sections of all drive rods face the respective heald frame coupling member in order to achieve an automatic coupling operation without any manual help;
- to make sure that the currently active drive rods forming pairs are movably held and guided at all times of their operation, and that the currently passive drive rods are held in defined positions while in the passive status; and
- to perform the guiding in accordance with a prescribed guided movement that presents the active drive rods in the proper operational position while keeping the passive drive rods out of the movement range of the active drive rods and in positions ready for an automatic coupling and decoupling when the currently passive rods are to become active and vice versa.

SUMMARY OF THE INVENTION

According to the invention a holding and guiding mechanism for each of two groups of heald shaft drive rods forming pairs is positioned at each side of the loom. Each holding and guiding mechanism comprises a plurality of guide tracks secured to the loom frame in a position outside of a range of a movement pattern of the heald shaft drive rods or connecting rods. The guide tracks extend substantially vertically or sufficiently vertically to permit a proper coupling with the heald frames, as will be described in more detail below. The guide tracks also extend in parallel to each other to assure proper guiding of the drive rods. Each guide track has a curved guide configuration, preferably a circular are guide configuration corresponding approximately to the travel path required for the active drive rods. The guide track configuration is sufficient as long as it enforces the required travel path or pattern for the active drive rods. Each of the drive rods has a guide follower that engages with its guided end a respective guide track in a movable manner.

Thus, it is important according to the invention that the active and the passive drive rod pairs are held and guided in common in curved yet substantially vertically oriented guide tracks which are arranged laterally and outside of the motion range of the active drive rods. A certain number of longitudinal guide tracks forms a first group of guide channels on one side of the loom, while an identical number of guide tracks forms a second group of guide channels on the opposite side of the loom. Each group of guide channels is preferably mounted through a respective bracket to lower crossbeams of the loom frame.

It is a further important feature of the invention that each guide track forms a curved, preferably a circular are guide channel, whereby each guide channel has a geometric horizontal cross-section that corresponds to or permits cooperation with the cross-section of a respective guided end of the corresponding guide follower riding along the respective guide channel. These cross-sections may any configuration as long as the guided end of the guide follower cross-section can cooperate with the guide track crosssection for the active drive rods to properly perform the guided movement and for the passive drive rods to be properly held in their passive position out of the way of the movement of the currently active drive rods. This feature permits the automatic coupling and decoupling without hindrance of one set of rods by the other and vice versa. In this connection, it is not important whether active or passive drive rods are involved, since all guide channels and guided ends of the guide follower can have the same cooperating cross-sections for the holding and/or guiding cooperation. It is, however important that the currently decoupled passive drive rods are held in a substantially vertical position, to assure a proper automatic coupling when such coupling is required.

The above features of the invention make it possible especially in looms in which the heald frames are automatically coupled with the respective drive rod pair to avoid a manual orientation or alignment of the rod pairs or rather of the coupling section of the rod pairs with the coupling section of the respective heald frame.

Another advantage of the invention is seen in that the machine vibrations no longer have any influence on the holding and/or guiding of the drive rods and that the operator no longer is required to manually work in an area that is hard to access when it becomes necessary to couple or decouple the rods from the respective heald frame. The positive holding and guiding of the heald frame drive rods according to the invention prevents the rods from getting loose, whereby the above mentioned damage is avoided.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 4:
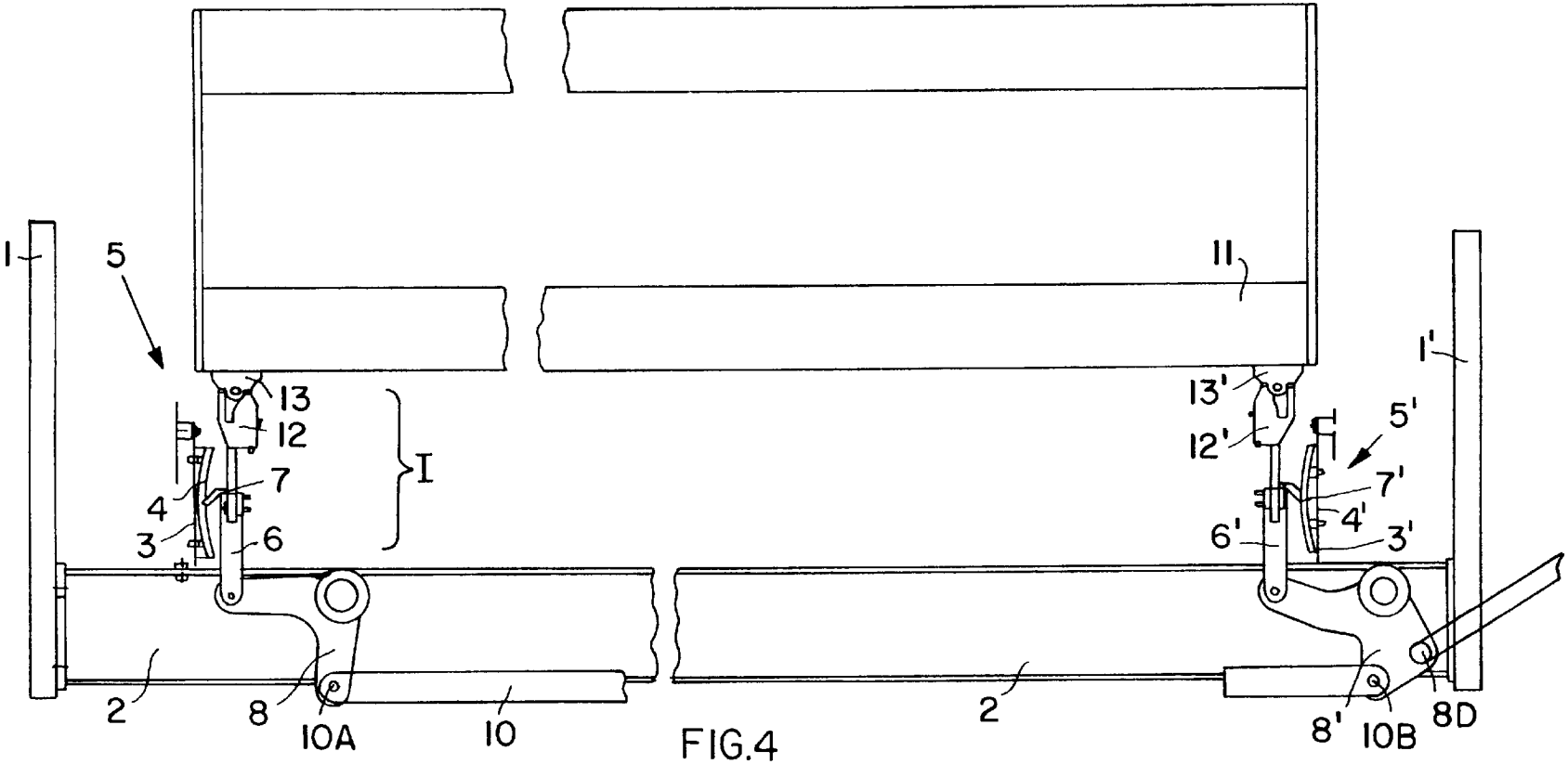
FIG. 4 illustrates the position of a "left" holding and guiding mechanism (5) and a "right" holding and guiding mechanism (5') next to the respective side walls (1 and 1') of the loom frame, wherein the mechanism (5) on the left side, as seen by the viewer, has a concave configuration, while the mechanism (5') on the right side has a convex guide configuration relative to a central vertical plane parallel to the side walls (1, 1') of the loom.

Referring first to FIG. 4, heald shafts or frames 11 are driven through two drive rods 6, 6' which are held and guided by respective rod holding and guiding mechanisms 5, 5'. One rod holding and guiding mechanism 5 is arranged on the left-side of the loom next to a loom frame side wall 1, as seen by the viewer, while the other rod holding and guiding mechanism 5' is arranged on the right-side of the loom next to the loom frame side wall 1'. Each mechanism 5, 5' holds and guides its drive rod 6, 6' to be described in more detail below. The mechanism 5, 5' are substantially identical. Therefore, the components of the mechanisms 5, 5' on the left and right side have the same reference numbers, however the numbers on the right side are provided with a prime (') designation and it is sufficient to describe only one side in detail.

Figure 1:
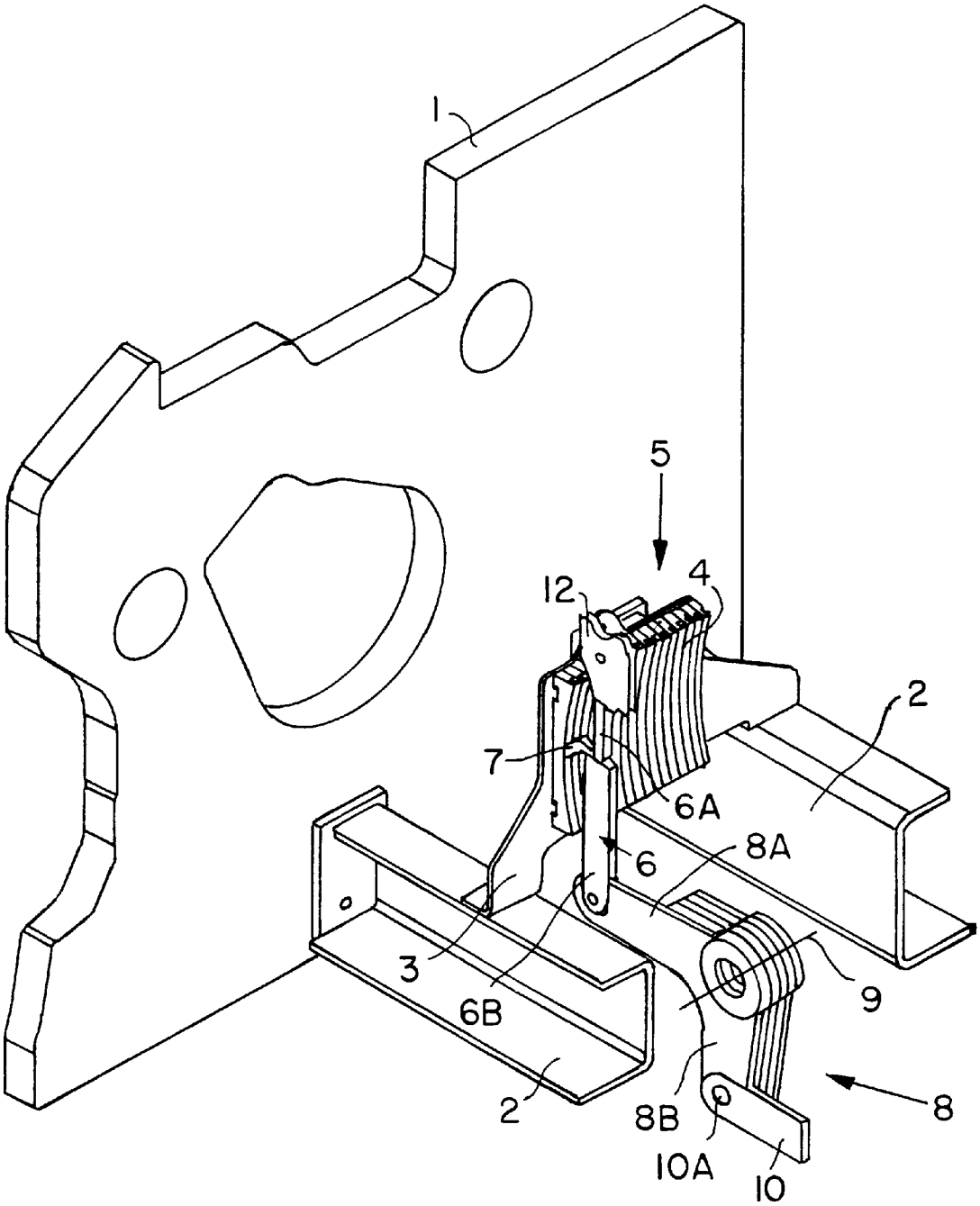
FIG. 1 is a perspective view on an enlarged scale of a detail I shown in FIG. 4 in a plan view illustrating the present holding and guide mechanism showing but one drive rod engaging a respective guide track.

FIG. 1 shows a perspective view of the left-side of the loom with the side wall 1 connected through lower crossbeams 2 to the side wall 1' shown in FIG. 4. A mounting bracket 3 is secured to the lower crossbeams 2. Each mounting bracket 3 carries a plurality of holding and guide tracks 4 arranged substantially vertically and in parallel to each other. A plurality of guide tracks 4 forms part of the holding and guiding mechanism 5 on the left side of the heald frame 11. A respective plurality of guide tracks 4' forms part of the mechanism 5' on the other side of the loom. In FIG. 1 the guide tracks 4 are connected to the mounting bracket 3 by suitable connectors 15 shown in more detail in FIG. 2. Each guide track 4 forms a curved, yet substantially vertically oriented guide channel 4A having guide walls 4B and 4C as best seen in FIG. 3. Each guide channel 4A is formed as a curved guide path that is preferably a portion of a circular arc, the size of which namely the radius of curvature and its circumferential arc length is determined by the motion characteristics required for the active drive rod 6 with its respective guide follower 7 riding with its guided end in or along the respective guide channel 4A. As shown in FIG. 3, the guide walls 4B and 4C of each guide track channel 4A are spaced from each other to provide play between the guided end of the guide follower 7 and the guide walls 4B, 4C. This play allows the drive rods to assume the above mentioned substantially vertical orientation.

Figure 2:
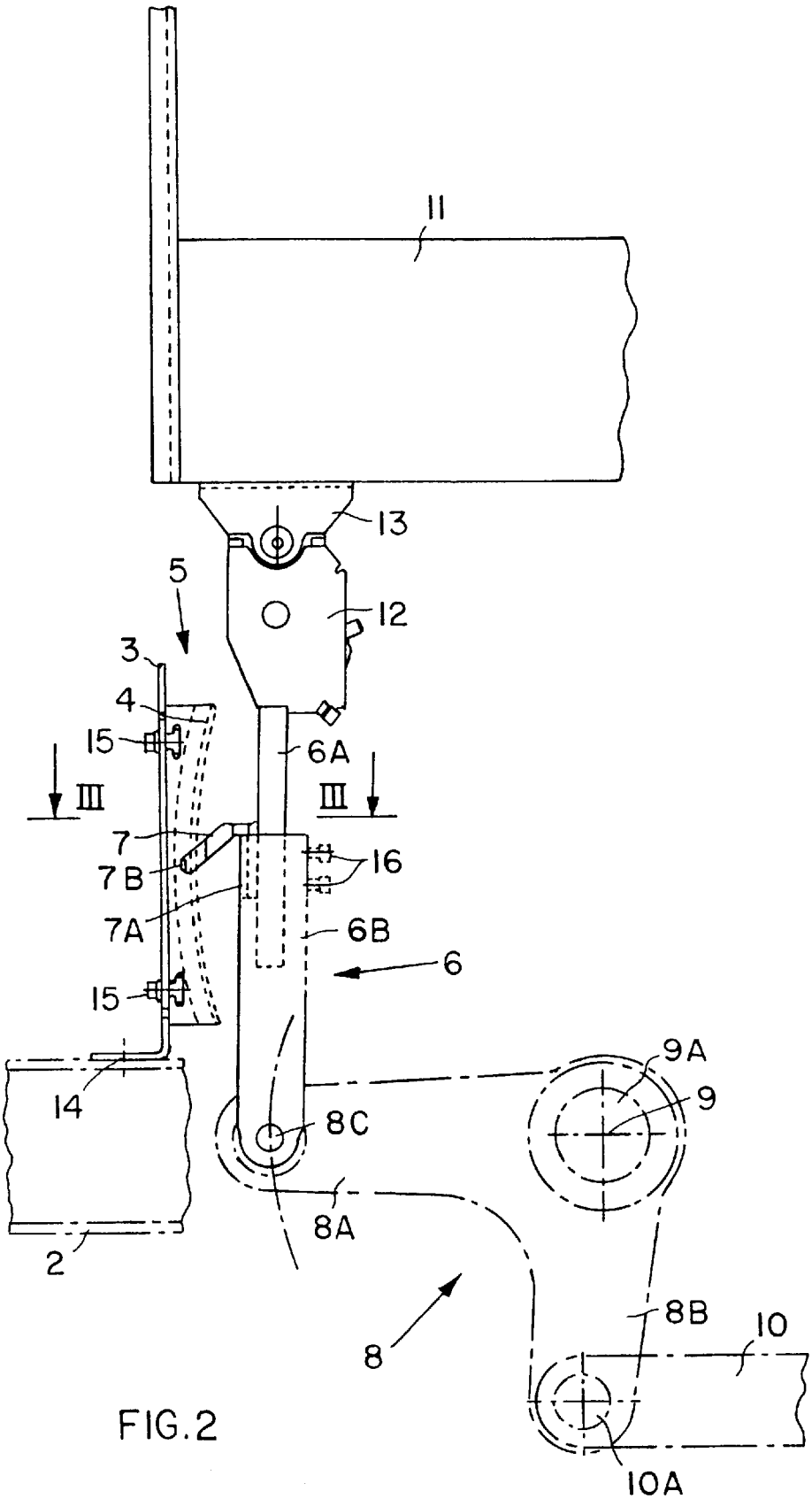
FIG. 2 illustrates, on an enlarged scale, compared to FIG. 4, a side view of the holding and guide mechanism cooperating with a drive rod coupled to the respective heald frame.
Figure 3:
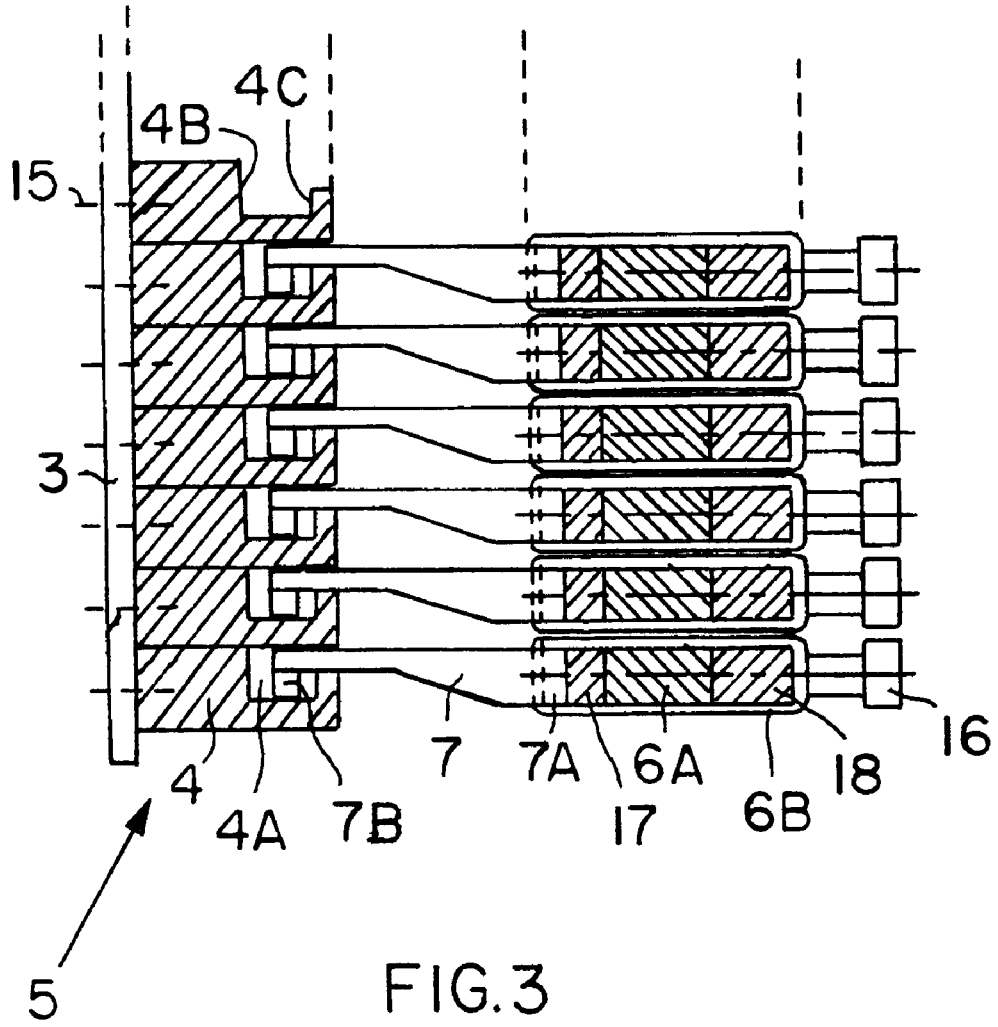
FIG. 3 is a sectional view along section line III—III in FIG. 2, illustrating the cross-sections of the guide channels and of the guided ends of the guide followers cooperating to permit a substantially vertical orientation of the respective drive rod.

Referring to FIG. 2, a plurality of bellcrank levers 8 is journalled on a shaft 9A provided in common for all bellcrank levers 8. The shaft 9A has a journal axis 9. One end of the drive rod 6 is journalled by a journal 8C to the free end of a bellcrank lever arm 8A of the first bellcrank lever 8. A free end of the other bellcrank lever arm 8B is connected to a linking bar 10 at a journal 10A. The linking bar 10 transmits a motion and drive control, in accordance with a pattern program, from a heald frame drive 8D shown in FIG. 4, to a heald shaft 11 through the drive rod 6. Thus, the mechanical transmission path between the heald frame drive 8D and the heald frame 11 passes through an upper coupling section 13, a lower coupling section 12, an upper rod section 6A, a lower rod section 6B, the journal 8C, the bellcrank lever arm 8A, the journal shaft 9A, the bellcrank lever arm 8B, the journal 10A, to the linking rod 10 as best seen in FIG. 2.

FIG. 2 further shows that the mounting bracket 3 is secured to the lower crossbeam 2 by connecting elements such as screws, rivets, welding, or the like only symbolically shown at 14. Similar connecting elements 15 secure the guide tracks 4 to the bracket 3.

As best seen in FIG. 2, the drive rods 6 are constructed in two sections, namely an upper rod section 6A connected to a lower coupling section 12 and a lower rod section 6B journalled at 8C to the arm 8A of the respective bellcrank 8. The rod section 6A is inserted into a hollow of the rod section 6B and held in place by set screws 16. The motion of each drive rod 6 is guided by its guide follower 7 which has a leg 7A secured to the rod section 6B for example by clamping, preferably by the same set screws 16 through clamping elements 17, 18 best seen in FIG. 3. The guide follower 7 has a guided end 7B which movably but firmly engages the respective guide track 4 in such a way that the rod 6 is properly guided along the required motion path.

FIG. 3 shows the above mentioned clamping connection of the leg 7A of the guide follower with the clamping elements 17 and 18 by the screws 16. The lower rod sections 6B of the rods 6 are positioned in parallel and next to each other and are connected to the lever arm 8A of the respective bellcrank 8. The lower ends of the upper rod sections 6A are inserted into an opening of the respective lower rod sections 6B and clamped between the two clamping bodies 17 and 18 movably positioned and held in the opening of the lower rod section 6B. Upon tightening the screws 16 the just mentioned are clamped together. Additionally, the connected leg 7A of the guide follower 7 is simultaneously clamped in the lower rod section 6B as best seen in FIGS. 2 and 3. The section 6B is preferably a hollow profile and the screw or screws 16 pass through a narrow side wall of the hollow profile to simultaneously clamp the clamping bodies 17 and 18 as well as the lower end of the upper rod section 6A and the guide follower leg 7A.

Referring further to FIG. 3, each guide track 4 comprises a guide channel 4A which preferably is open laterally so that the guided end 7B of the guide follower 7 can reach into the guide channel 4A for a positive holding and guiding along the guide track 4. The guide end 7B and the cross-section of the opening 4A may have any desired geometric configuration provided that the guided free end 7B is properly held in a movable manner in the guide track. Sufficient play is provided between the guided end 7B and the respective guide channel 4A to assure proper movability of the rods 6 along their required motion path and to permit a substantially vertical orientation of the drive rods 6 as explained above with reference to the channel guide wails 4B, 4C. Such play must assure the proper holding and guiding of the active rods and a proper holding of the passive rods, whereby any of the rods may be caused to assume either a passive or an active role. The play will also take into account the curvature of the guide tracks 4 to allow for said substantially vertical orientation of the drive rods 6.

FIG. 4 shows how the bellcranks 8 and 8' are interconnected through the connecting bar 10. The ends of the bar 10 are journalled to the pivot points 10A and 10B of the respective bellcranks 8 and 8'. The bellcrank 8' is connected to the shaft drive 8D. The shaft drive itself is conventional. The two shaft drive rods 6 and 6' form a rod pair.

Each upper section 6A of a drive rod 6, 6' carries a coupling section 12, 12' which in turn is connected or coupled to an upper coupling section 13, 13' secured to the respective heald frame 11 thereby coupling the rods to the heald frame 11. As mentioned above, the left-hand guide tracks 4 of the left holding and guide mechanism 5 have a concave configuration while the guide tracks 4' of the right-hand holding and guide mechanism 5' have a convex configuration relative to a central vertical plane parallel to the side walls 1, 1' of the loom. In both instances the guided end 7B of the guide follower 7, 7' engages the corresponding guide channel of the respective guide track 4, 4'.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A weaving loom comprising a loom frame (1, 2), at least two heald frames (11) for cooperation with said loom, a plurality of first and second connecting drive rods (6, 6'), first couplings (12) each secured to a respective drive rod (6, 6') of said connecting drive rods (6, 6'), second couplings (13) secured to said heald frames (11) for cooperation with said first couplings, a first mechanism (5) for holding and guiding said first connecting drive rods (6) on one side of said loom, a second mechanism (5') for holding and guiding said second connecting drive rods (6') on the other side of said loom, each of said first and second holding and guiding mechanisms (5, 5') comprising a plurality of guide tracks (4, 4') secured to said loom frame (2) in a position for holding and guiding said first and second connecting drive rods (6, 6') in accordance with a movement pattern for said first and second connecting drive rods (6, 6'), said guide tracks (4, 4') extending substantially vertically and in parallel to each other, each guide track (4, 4') having a curved guide configuration, each of said connecting drive rods (6, 6') comprising a guide follower (7) having a guided end (7B) movably engaging a respective guide track of said plurality of guide tracks (44) for holding and guiding said connecting drive rods (6, 6') to enforce said movement pattern and to present said connecting drive rods (6, 6') with said first couplings (12) in defined positions for cooperation with said second couplings (13) for an automatic change of said heald frames.

2. The weaving loom of claim 1, wherein said curved guide configuration has a circular arc profile which corresponds to said movement pattern of said connecting drive rods (6, 6').

3. The weaving loom of claim 1, wherein said guide tracks (4, 4') and said guided end (7B) of said guide follower (7) have cooperating sectional configurations in a horizontal plane with play between said guided end (7B) of said guide follower (7) and the respective guide track.

4. The weaving loom of claim 1, wherein said loom frame comprises lower crossbeams (2) and side walls (1, 1') interconnected by said crossbeams and a separate mounting bracket (3, 3') for each of said first and second holding and guiding mechanisms (5, 5'), said separate mounting brackets securing the respective holding and guiding mechanism to said lower crossbeams (2).

5. The weaving loom of claim 1, wherein said curved guide configurations of said plurality of guide tracks of said first holding and guiding mechanism (5) are identical to each other.

6. The weaving loom of claim 5, wherein said curved guide configurations of said first holding and guiding mechanism (5) are concave.

7. The weaving loom of claim 1, wherein said curved guide configurations of said guide tracks of said second holding and guiding mechanism (5') are identical to each other.

8. The weaving loom of claim 7, wherein said curved guide configurations of said second holding and guiding mechanism (5') are convex.

9. The weaving loom of claim 1, further comprising a securing mechanism (16, 17, 18) attaching said guide follower (7) to its respective connecting and drive rod (6, 6') in a position between ends of said connecting drive rod.

10. The weaving loom of claim 1, further comprising a connector link (10), a heald rod drive (8D), and link elements (8, 8') for journalling said connecting and drive rods (6, 6') to said heald rod drive (8D) through said connector link (10).

11. The weaving loom of claim 10, wherein said link elements (8, 8') are bellcranks.

12. A connecting rod holding and guiding apparatus for heald shafts in a loom, said apparatus comprising a plurality of connecting drive rods (6 or 6') and a holding and guiding mechanism (5 or 5') for said connecting drive rods, a separate coupling (12) secured to one end of each of said connecting drive rods (6, 6'), said holding and guiding mechanism comprising a corresponding plurality of guide tracks (4) one for each of said connecting drive rods, said guide tracks (4) extending substantially vertically and in parallel to each other, each guide track having a curved guide configuration, each of said connecting drive rods (6) comprising a guide follower (7) having a guided end (7B) movably engaging a respective guide track of said plurality of guide tracks for holding and guiding said connecting drive rods (6) for presenting each said separate coupling in a position adapted for cooperation with a respective coupling of said heald shafts for an automatic heald shaft exchange.

13. The apparatus of claim 12, wherein said curved guide configuration has a circular arc profile which corresponds to a movement pattern of said connecting drive rods (6, 6') for said automatic heald shaft exchange.

* * * * *

UNITED STATES PATENT AND TRADEMARK OFFICE

CERTIFICATE OF CORRECTION

PATENT NO. : 5,931,202

DATED : August 3, 1999

INVENTOR(S) : Haeussier et al

It is certified that error appears in the above-identified patent and that said Letters Patent is hereby corrected as shown below:

On the title page: Item [56] Foreign Patent Documents":

line 1, after "6/1955", replace "Australia", by --Austria--;

Col. 2, line 33, after "drive", insert --rods of a heald frame--; after "guided" delete "of a";
line 34, before "to", delete "heald frame";
line 66, before "guide", replace "are", by --arc--;

Col. 3, line 17, after "circular", replace "are", by --arc--;
line 22, after "may" insert --assume--;

Col. 5, line 15, before "rod" insert --drive--;
line 27, after "follower" insert --7--;
line 36, before "are", insert --elements--;
line 48, after "The", replace "guide", by --guided--;
line 56, after "guide", replace "wails", by --walls--;

Signed and Sealed this
First Day of February, 2000

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,931,202

DATED : August 3, 1999

INVENTOR(S) : Haeussler et al.

It is certified that error appears in the above-identified patent and that said Letters Patent is hereby corrected as shown below:

On the Title Page, Item [56] under "FOREIGN PATENT DOCUMENTS":
line 1, after "6/1955", replace "Australia", by --Austria--;

Col. 2, line 33, after "drive", insert --rods of a heald frame--; after "guided" delete "of a";
line 34, before "to", delete "heald frame";
line 66, before "guide", replace "are", by --arc--;

Col. 3, line 17, after "circular", replace "are", by --arc--;
line 22, after "may" insert --assume--;

Col. 5, line 15, before "rod" insert --drive--;
line 27, after "follower" insert --7--;
line 36, before "are", insert --elements--;
line 48, after "The", replace "guide", by --guided--;
line 56, after "guide", replace "wails", by --walls--;

This certificate supersedes Certificate of Correction issued February 1, 2000.

Signed and Sealed this

Fifteenth Day of August, 2000

*Attest:*

Q. TODD DICKINSON

*Attesting Officer*

*Director of Patents and Trademarks*